United States Patent [19]

Isomura et al.

[11] Patent Number: 4,586,479

[45] Date of Patent: May 6, 1986

[54] ELECTRONIC FUEL INJECTION CONTROL WITH VARIABLE INJECTION INTERVALS

[75] Inventors: Shigenori Isomura; Yasumasa Kaji, both of Kariya, Japan

[73] Assignee: Nippondenso Co., Ltd., Kariya, Japan

[21] Appl. No.: 596,593

[22] Filed: Apr. 4, 1984

[30] Foreign Application Priority Data

Apr. 5, 1983 [JP] Japan ..... 58-60312

[51] Int. Cl.[4] ..... F02D 41/10

[52] U.S. Cl. ..... 123/492; 123/478

[58] Field of Search ..... 123/478, 480, 492

[56] References Cited

U.S. PATENT DOCUMENTS 4,200,063 4/1980 Bowler ..... 123/478
4,363,307 12/1982 Amano et al. ..... 123/480
4,388,907 6/1983 Sugo et al. ..... 123/478
4,401,087 8/1983 Ikeura ..... 123/492
4,512,320 4/1985 Abe et al. ..... 123/492

*Primary Examiner*—Andrew M. Dolinar
*Attorney, Agent, or Firm*—Cushman, Darby & Cushman

[57] ABSTRACT

In a fuel injection control system for an internal combustion engine, operating conditions of the engine are constantly monitored. A transient condition of the engine is detected from the monitored operating conditions. A fuel injection quantity is derived from the monitored operating conditions to effect injection at first intervals during the absence of the transient condition and at second intervals during the presence of the transient condition. Fuel injectors are activated in response to the derived fuel injection quantity.

8 Claims, 8 Drawing Figures

ELECTRONIC FUEL INJECTION CONTROL WITH VARIABLE INJECTION INTERVALS

BACKGROUND OF THE INVENTION

The present invention relates to an electronic fuel injection control system for internal combustion engines, and more particularly to such a control system wherein fuel injection is effected at variable intervals in response to a transient in an engine operating condition.

In a prior art electronic fuel injection system, cylinders are simultaneously supplied with fuel at intervals of 720-degree revolution of the engine crankshaft, or each combustion cycle. Fuel injection quantity is derived from intake air quantity and engine speed at 720° intervals to meet power demands under varying operating conditions. When engine acceleration demand occurs immediately after the derivation of the fuel quantity, there occurs a sharp increase in intake air, and therefore air-fuel mixture becomes leaner than is required for acceleration, resulting in an engine having a slow response characteristic to acceleration.

Furthermore, in modern automobiles in which fuel is injected for every two crankshaft revolutions during periods of engine idle, an attempt to inject fuel twice that interval would generate a fuel injection pulse having a duration smaller than the minimum open-time of fuel injectors.

SUMMARY OF THE INVENTION

Accordingly, an object of the present invention is to eliminate the problems associated with the prior art electronic fuel injection control system.

Another object of the present invention is to provide a fuel injection control system in which a transient in an operating condition of the engine is detected in order to change the fuel injection intervals to control the air-fuel ratio under varying engine operating conditions to achieve precision fuel injection control.

A further object of the present invention is to provide a fuel injection control system in which fuel injection is effected at shorter intervals to enrich the air-fuel mixture in response to engine acceleration in order to improve the engine's response characteristic to acceleration.

A still further object of the present invention is to provide a fuel injection control system in which fuel injection is effected at shorter intervals in response to engine start to improve the engine's starting performance and fuel injection is effected at longer intervals in response to engine deceleration to provide high precision injection control under light load conditions.

A still further object of the present invention is to provide a fuel injection control system which effects optimized air-fuel control under varying engine operating conditions for optium economy and drivability.

BRIEF DESCRIPTION OF THE DRAWINGS

The present invention will be described in further detail with reference to the accompanying drawings, in which.

DETAILED DESCRIPTION

Figure 1:
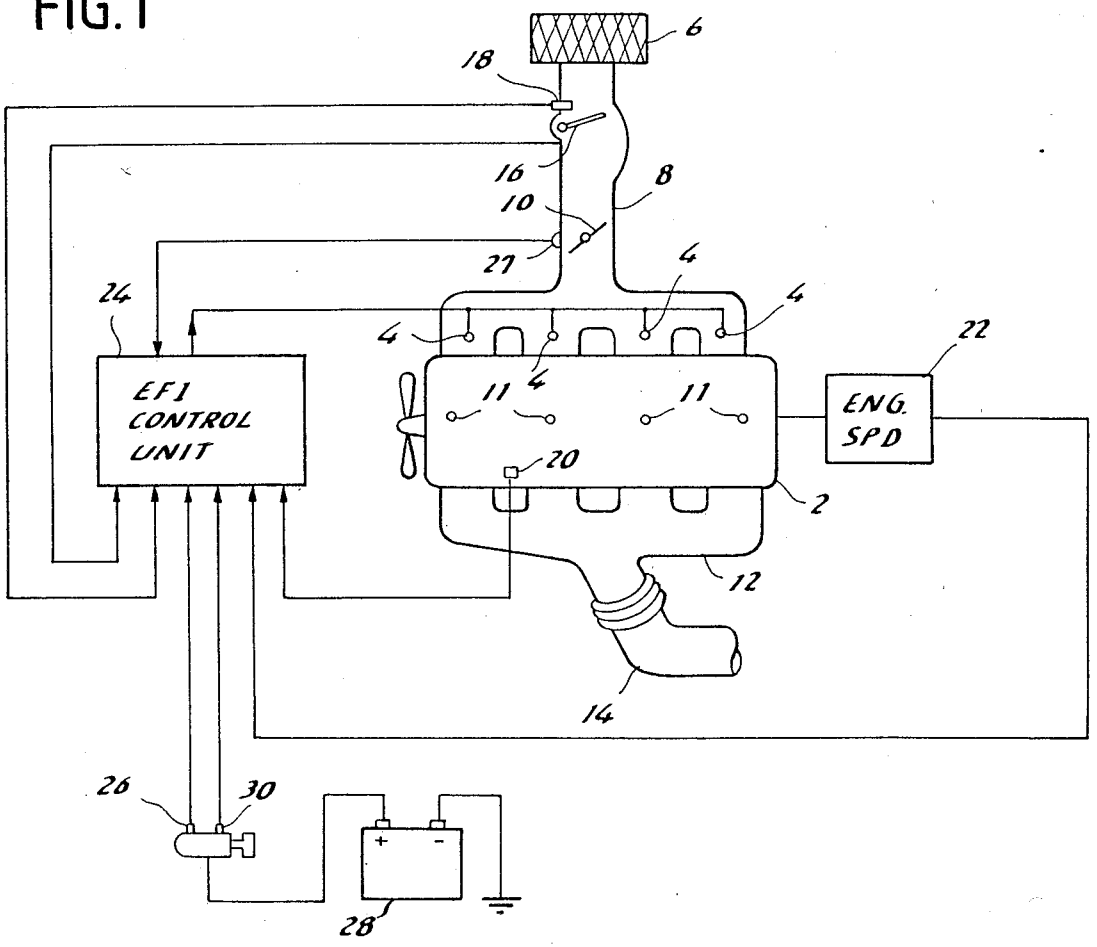
FIG. 1 is a block diagram of an electronic fuel injection control system according to the present invention.

In FIG. 1 is shown an electronic fuel injection control system of the present invention incorporated in a four-cycle spark ignition internal combustion engine 2 which is provided with an intake manifold 8 with an air cleaner 6 and a throttle valve 10 therein, fuel injection solenoid valves 4, spark plugs 11, an exhaust manifold 12 and an exhaust pipe 14. A catalytic converter, not shown, may be provided in the exhaust pipe 14 to effect the catalytic conversion of unburned fuel to harmless products. Various engine condition sensors are provided which include a potentiometer-type intake airflow sensor 16, an intake air temperature sensor 18, an engine coolant temperature sensor 20, an engine speed sensor 22 and a throttle angular position sensor 27 which is operatively coupled to throttle valve 10. More specifically, the intake airflow meter 16 provides an analog voltage signal representing the amount of air inducted to the engine and the air temperature sensor 18 provides an analog voltage signal indicative of the temperature of the inducted air. Similarly, the engine coolant temperature sensor 20 provides an analog voltage signal representing the operating temperature of the engine 2. The engine speed sensor 22 detects the speed of rotation of engine crankshaft and generates pulses at a frequency proportional to the rotational speed. Such speed indicating pulses may be derived from the primary winding of ignition coil.

A fuel injection control unit 24 is powered through an engine starter switch 26 and an ignition key switch 30 from a vehicle-mounted storage battery 28 to start processing input signals from the various sensors noted above to derive optimum fuel quantity to be injected. This quantity is expressed by the duration of a pulse to be applied to fuel injection valves 4.

Figure 2:
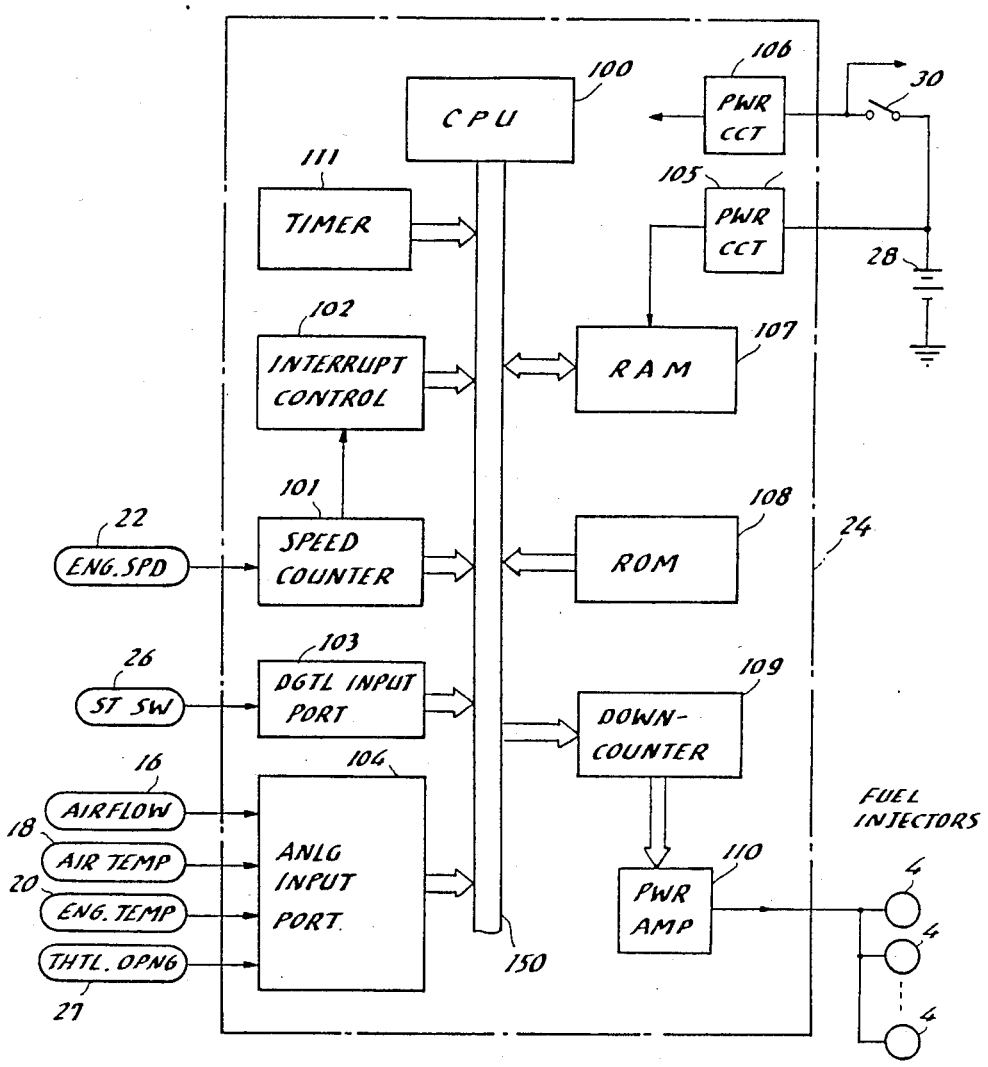
FIG. 2 is a block diagram illustrating the hardware of the control unit of FIG. 1 with associated sensors.

More specifically, the control unit 24 is a microcomputer which is shown in detail in FIG. 2 as comprising a microprocessor or central processing unit (CPU) 100. Digital signals to and from the CPU are carried on a common bus 150 to which are coupled various units including an engine speed counter 101 which is responsive to the speed sensor 22. The speed counter 101 enables an interrupt control unit 102, at intervals of 360° crank angle, to place an interrupt command signal to the CPU and at the same time issues a binary count value indicating the speed of the engine to the CPU. A digital input port 103 transmits on-off signals from the starter switch 26 to the CPU as an indication of engine start condition and analog input port 104 provides interface between analog type sensors such as airflow meter 16, air temperature sensor 18, engine temperature sensor 20 and throttle position sensor 27 and the CPU. The analog input port comprises an analog multiplexer and an analog-to-digial converter to sequentially transmit digitized signals to the CPU. Random access memory 107, which is permanently powered through a stabilizer circuit 105 from the battery 28, serves as a store for various data necessary for the CPU to process the programmed instructions. Because of the permanent connection, the RAM acts virtually as a nonvolatile memory, so that data stored in one engine operation are stored during standstill periods and put to use for fuel injection control in a subsequent engine operation.

Programmed instructions describing the fuel injection control algorithm of the present invention are stored in read-only memory 108. Based upon the instructions, input signals from the various sensors are processed to generate output data to be supplied to a programmable downcounter 109. The counter 109 converts the output data into a fuel injection pulse which is intensified by a power amplifier 110 to a power level sufficient to drive fuel injectors 4. A power supply circuit 106 is connected to the battery 28 through the ignition switch 30 to serve as a power supply for the various units of the microcomputer except for the random access memory 107. Also included is a timer 111 which provides timing pulses which are counted in the CPU to provide a count value indicative of the engine speed.

Figure 3:
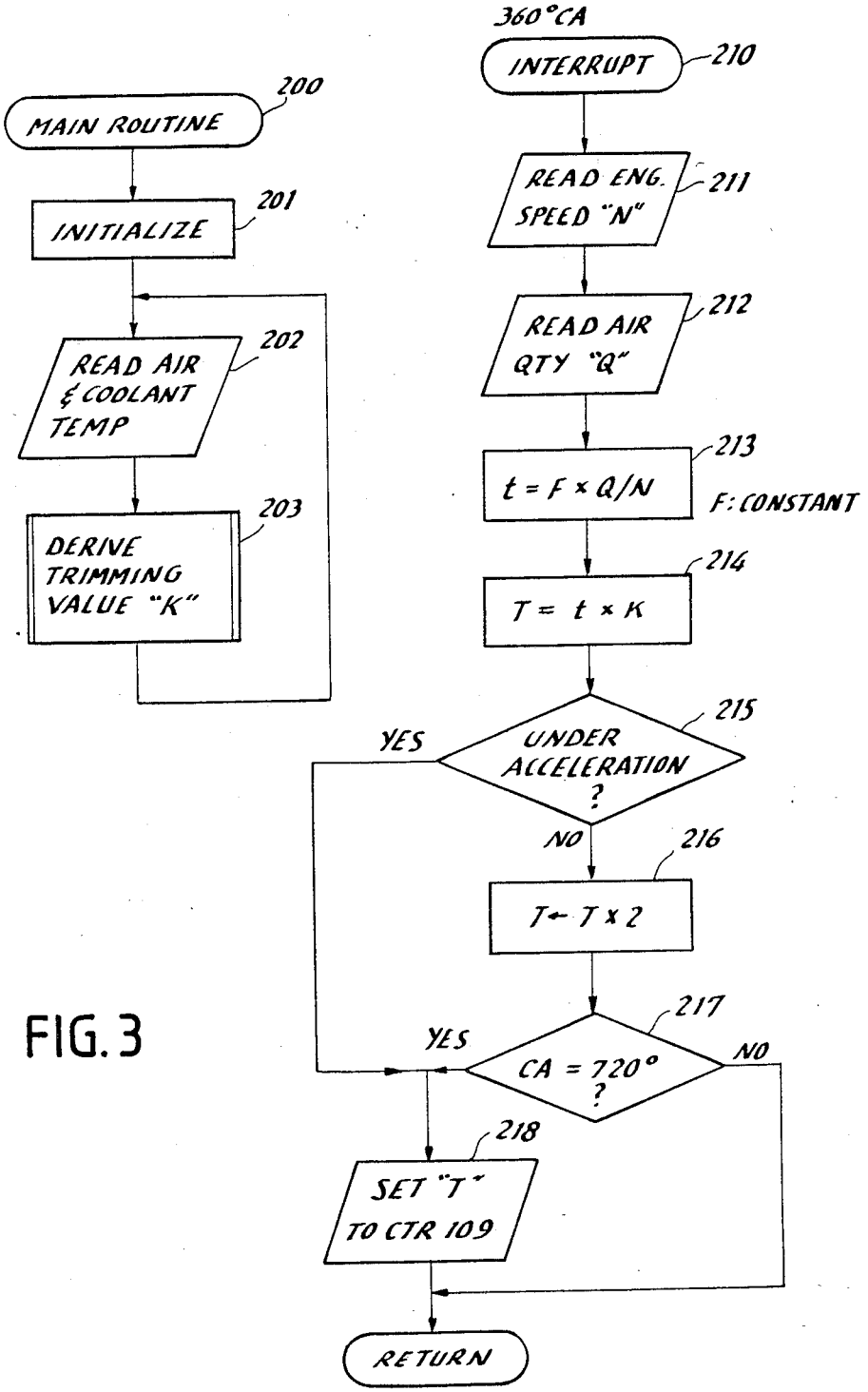
FIG. 3 is a flowchart describing the control algorithm of the microcomputer of FIG. 2.

Referring to FIG. 3, there is shown the programmed instructions of the present invention. When starter switch 26 and ignition key switch 30 are operated, the microcomputer 24 is powered and the processing of a main routine 200 is initiated. Step 201 is first executed to initialize the microcomputer, then followed by Step 202 where signals from the air temperature sensor 18 and engine coolant temperature sensor 20 are converted to corresponding digital signals and sequentially written into the RAM 107. As a function of these temperature signals, a trimming value K is determined from a lookup table. This trimming value is stored in a specified storage location of the RAM for later use in an interrupt routine. Control returns to the Step 202 to constantly update the trimming value in accordance with varying engine operating conditions.

The main routine 200 is interrupted in response to an interrupt command signal generated in the interrupt control unit 102. An interrupt routine 210 is initiated at Step 211 in which a speed count value N is read from engine speed counter 211 into a specified location of the RAM. Step 212 follows to read an inducted air quantity Q from the input port 104 into a specified location of the RAM.

At Step 213, a basic fuel injection quantity, which is represented by the injector open-time t (in milliseconds) and which is required for one crankshaft revolution, is determined by computing an equation $F \times Q/N$, where F is a constant. The basic fuel injection time t is corrected by the trimming value K read from the memory 107 (Step 214) by multiplying t by K, so that a corrected basic fuel injection open-time T is derived.

At Step 215, the microprocessor 100 determines whether the engine is coasting or under acceleration. If coasting, control exits to a Step 216 to double the corrected fuel quantity T and then to a Step 217 to check to see if the crank angle equals 720°. If the crank angle is below 720°, program returns to the main routine and repeats the above process, so that in the next interrupt routine control will exit from Step 217 to a Step 218 and preset the doubled open-time value T obtained at Step 216 into the programmable downcounter 109. Downcounter 109 is thus preset to a count which corresponds to T and initiates counting clock pulses until the preset value is reached, producing a pulse having a width corresponding to T. When the engine is coasting, all the fuel injectors are therefore simultaneously energized for a duration twice the basic injector open-time T at intervals of 720° crank angle.

If the engine is under acceleration, control goes to Step 218, presetting the downcounter 109 to the corrected basic open-time T. Therefore, the fuel injection is effected at intervals of 360° crank angle with a fuel quantity one-half the quantity of coasting drive.

Figure 4:
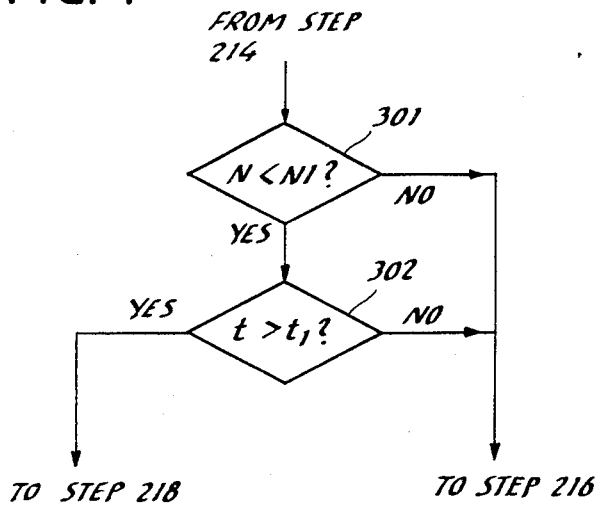
FIGS. 4 and 5 are flowcharts describing the details of the transient detecting step of FIG. 3.
Figure 5:
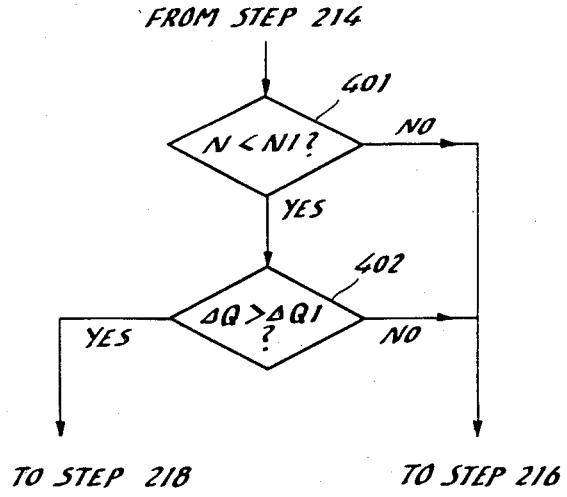

FIGS. 4 and 5 are illustrations of the details of Step 215 of FIG. 3. In FIG. 4, engine acceleration is detected by two successive Steps 301 and 302. In Step 301, engine speed value N is compared with a predetermined value N1 which typically represents an engine speed of 3000 rpm.

If $N > N1$, the microprocessor 100 interprets it as a coasting drive and advances to Step 216 to effect injection at longer intervals. The reason for this is that for $N > N1$, the injection interval would be too short to supply a sufficient amount of fuel during acceleration and there is an inherent dead time of more than 1 millisecond at each fuel injection which must be taken into account.

If $N < N1$, control goes to Step 302 to compare the basic injector open-time t obtained at Step 213 with a predetermined value $t_1$ (typically, 2.5 milliseconds). If $t < t_1$, the microprocessor recognizes it as a coasting drive and goes to Step 216 and if $t > t_1$, the engine condition is interpreted as acceleration and control goes to Step 218 to effect fuel injection at shorter intervals.

Alternatively, engine acceleration is detected by Steps 401 and 402 in FIG. 5. As in Step 301, engine speed value N is compared with N1 in Step 401 which is followed by Step 402 when $N < N1$ is detected to provide comparison between an air quantity variation $\Delta Q$ (which is derived from Q at Step 212) and an air quantity variation $\Delta Q1$ which was derived in the previous crankshaft revolution. Typically, $\Delta Q1$ is 2 $cm^3$/milliseconds. Acceleration is detected if $\Delta Q > \Delta Q1$ and Step 402 is followed by Step 218 to effect high-speed injection. If otherwise, control advances to Step 216.

Figure 6:
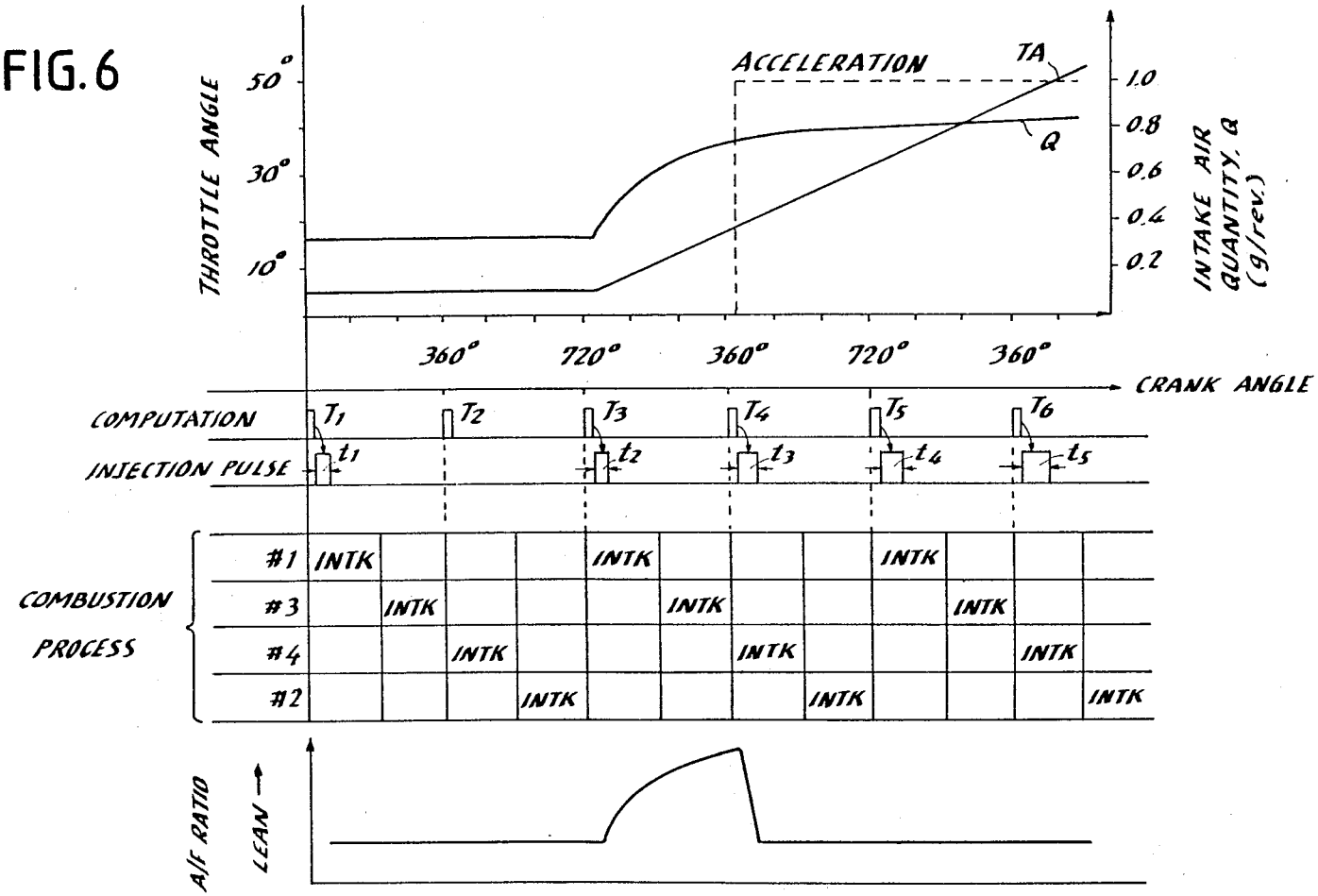
FIG. 6 is an illustration useful for better understanding the present invention.

For better understanding of the present invention reference is made to FIG. 6. Illustrated at $T_1$ to $T_6$ are timings at which the main routine is interrupted to initiate the computation of the fuel injection quantity. In the interrupt routines $T_1$ to $T_3$, in which the engine is coasting, fuel injection is made at intervals of 720° crank angle. Acceleration is detected in the interrupt routine $T_4$ and fuel injection frequency is switched to 360° intervals. Therefore, fuel is increased at $T_4$ to enrich the air-fuel mixture to deliver sufficient power for the acceleration. Without this switching action, the air-fuel mixture would be further leaned until injection is made at $T_5$, so that power is not sufficient to meet desired acceleration.

Figure 7:
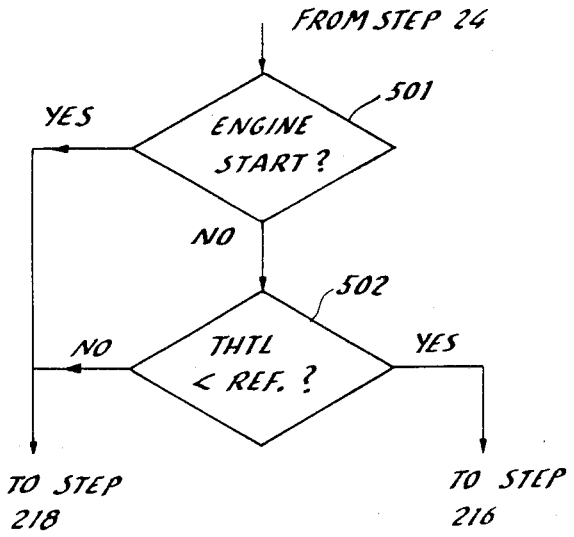
FIGS. 7 and 8 are flowcharts describing alternative methods for detecting a transient in engine operating conditions.

The present invention is also useful for engines under deceleration. FIG. 7 is an illustration of flowcharts for switching fuel injection timing during engine deceleration when the angle of throttle opening is smaller than a predeteremined value. At Step 501, the microprocessor checks to see if the engine is started, and if so, control goes to Step 218 to effect injection at 360° intervals, and if not, control goes to Step 502 to check to see if the throttle angle is smaller than a 5% value of the total opening angle. If the angle is smaller than the 5% value, the engine condition is interpreted as deceleration or idling and control advances to Step 216 to effect injection at 720° intervals. The detection of engine start may be made by comparison between the engine speed value and a reference speed and generating a signal when the engine speed is below the reference speed or by utilizing the signal from the starter switch.

Figure 8:
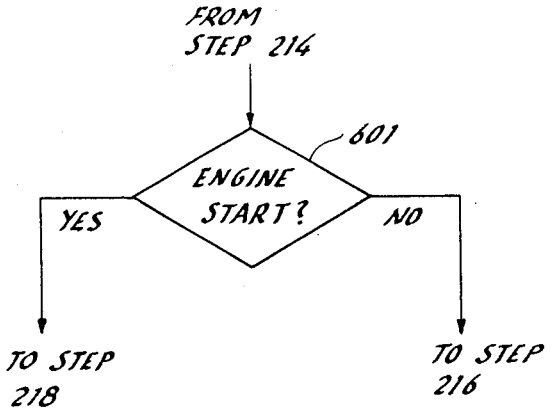

FIG. 8 illustrates an alternative subroutine for detecting the engine start condition. If the engine is being started, control exits to Step 218 to effect fuel injection at 360° intervals and if not, Step 216 is executed for 720°-interval injection. Engine start condition may be detected when the engine speed is below a predetermined setting as in FIG. 7.

The foregoing description shows only preferred embodiments of the present invention. Various modifications are apparent to those skilled in the art without departing from the scope of the present invention which is only limited by the appended claims. For example, in the foregoing description engine transient conditions are detected by the variation of engine speed. However, such transient conditions could equally be as well detected by sensing the variation of fuel injection time and air intake quantity, the on-off condition of the starter switch and the thorttle position since these operating parameters vary as a function of engine speed.

While in the previous embodiments, longer-interval injection is made simultaneously for all cylinders once for every two crankshaft revolutions and shorter-interval injection is made simultaneously for all cylinders at every crankshaft revolution, various forms of injection patterns can be comtemplated within the scope of the present invention. Table below shows alterations of such injection pattern.

TABLE

| Mode | Longer-Interval Injection | Shorter-Interval Injection |
|---|---|---|
| A | Simultaneous injection at each revolution | Simultaneous injection for every ½ to ¼ revolution |
| B | Cylinder group injection once for every two revolutions | Cylinder group injection at each revolution |
| C | Cylinder group injection at each revolution | Cylinder group injection once for every ½ to ¼ revolution |

In mode A, fuel injection is made at 360° intervals simultaneously to all cylinders during coasting or deceleration and switched to a shorter interval in a range from 90° to 180° during acceleration. In mode B, injection is made on a cylinder-group individual basis at 720° intervals during coasting and deceleration and switches to 360° intervals during acceleration. In mode C, individual injection is effected at 360° intervals during coasting and deceleration and switches to a shorter interval in the range between 90° and 180° intervals during acceleration.

What is claimed is:

1. A fuel injection control system for an internal combustion engine having fuel injectors, comprising:

first means for monitoring operating conditions of said engine;

second means for detecting whether said engine is in an accelerating condition in accordance with the monitored operating conditions, computing an amount of fuel to be injected into said engine in accordance with the monitored operating conditions, generating at occurrence of a predetermined rotation of said engine a first series of pulses, each pulse having a duration greater by a predetermined value than a duration corresponding to said computed amount of fuel, and generating during the detected acceleration condition a second series of pulses, the pulses of said second series being interposed, in time, between those of said first series, said pulses of said second series having a duration corresponding to said computed amount of fuel; and third means for activating said fuel injectors in response to the pulses of both said first and second series.

2. A fuel injection control system according to claim 1, wherein said duration of said first pulse is twice as great as that of said second pulse.

3. A fuel injection control system for an internal combustion engine having fuel injectors, comprising:

first means for detecting operational conditions of said engine;

second means for detecting acceleration of said engine;

third means for determining, based on a predetermined function, a first amount of fuel in accordance with the detected operational conditions of said engine;

fourth means for activating said fuel injectors at occurrence of a predetermined angular rotation of said engine so that an amount of fuel twice that of said first amount of fuel as determined by said third means is supplied to said engine; and fifth means, responsive to acceleration detected by said second means, for activating said fuel injectors to inject during detected acceleration said first fuel amount at an angular rotation position of said engine halfway between two consecutive occurrences of said predetermined angular rotation.

4. A fuel injection control system as claimed in claim 3, wherein said second means is arranged to detect said acceleration when the speed of said engine is below a predetermined value.

5. A fuel injection control system as claimed in claim 3, wherein said second means is arranged to detect said acceleration when the speed of said engine is below a predetermined speed value and said first fuel injection amount is above a predetermined injection amount.

6. A fuel injection control system according to claim 3, wherein said first means includes means for detecting an amount of air sucked into said engine and means for detecting rotational speed of said engine; and said third means includes means, responsive to said first means, for determining said first amount of fuel in proportion to the detected amount of air and in inverse proportion to the detected rotational speed.

7. A fuel injection control system according to claim 6, wherein said second means includes means, responsive to said first means, for producing an output indicative of acceleration when the detected rotational speed is below a predetermined speed and a present variation of the detected air is longer than the previous variation of the detected air.

8. A fuel injection control system according to claim 7, wherein said third means determines said first amount of fuel at every one rotation of said engine and said fourth means activates said fuel injector at every other rotation of said engine.

* * * * *